United States Patent [19]

Luscomb

[11] 4,219,154

[45] Aug. 26, 1980

[54] ELECTRONICALLY CONTROLLED, SOLENOID OPERATED FUEL INJECTION SYSTEM

[75] Inventor: Douglas A. Luscomb, Mt. Upton, N.Y.

[73] Assignee: The Bendix Corporation, Southfield, Mich.

[21] Appl. No.: 923,137

[22] Filed: Jul. 10, 1978

[51] Int. Cl.[2] ..... F02M 47/02

[52] U.S. Cl. ..... 239/91; 123/457; 123/472; 239/585

[58] Field of Search ..... 239/88–92, 239/95, 124, 125, 585, 533.3, 533.4, 533.7, 533.9; 123/32 JV, 139 DP, 139 E, 139 AK, 139 AM, 139 AT

[56] References Cited

U.S. PATENT DOCUMENTS

| | | | |
|---|---|---|---|
| 3,796,206 | 3/1974 | Links | 123/139 AK X |
| 3,835,829 | 9/1974 | Links | 123/139 E |
| 3,921,604 | 11/1975 | Links | 123/139 E |
| 3,943,901 | 3/1976 | Takahashi et al. | 123/139 AT X |
| 4,069,800 | 1/1978 | Kanda et al. | 123/139 E X |
| 4,129,256 | 12/1978 | Bader et al. | 239/585 X |

*Primary Examiner*—Johnny D. Cherry

*Attorney, Agent, or Firm*—Russel C. Wells; Gaylord P. Haas, Jr.; Markell Seitzman

[57] ABSTRACT

A fuel injection system (10) for injecting fuel into the combustion chamber of an internal combustion engine includes a multi-way valve (30), a solenoid (42) for controlling the operation of the valve, a shuttle valve (38) that is moved within a shuttle chamber (37) in response to the change of state of the solenoid, and an intensifier piston (62) having an upper cylinder (62) movable within actuating chamber (49) and a lower cylinder (66) movable within metering chamber 50. The position of the shuttle valve, in turn, regulates the admission of pressurized fuel from a high pressure pump (152) into the actuating chamber (49) to drive the intensifier piston in a first direction. The lower cylinder 66 of the piston 62 is movable within the metering chamber (50) to amplify the pressure of the fuel to a level several times greater than supply pressure prior to introducing same into a fuel injector (78) for discharge into the combustion chamber. A T-shaped passage (70) in the piston (66) allows the injection phase of the cycle of operation to be terminated sharply by a rapid dissipation of the pressure buildup. Variable restrictions (144, 146) such as a needle valve, are disposed in a return conduit that allows the fuel in the actuating chamber (49) to be returned to the fuel reservoir (39) and to regulate the volume of fuel that can return to the reservoir per unit of time during the metering phase of operation.

16 Claims, 11 Drawing Figures

FIG. I.
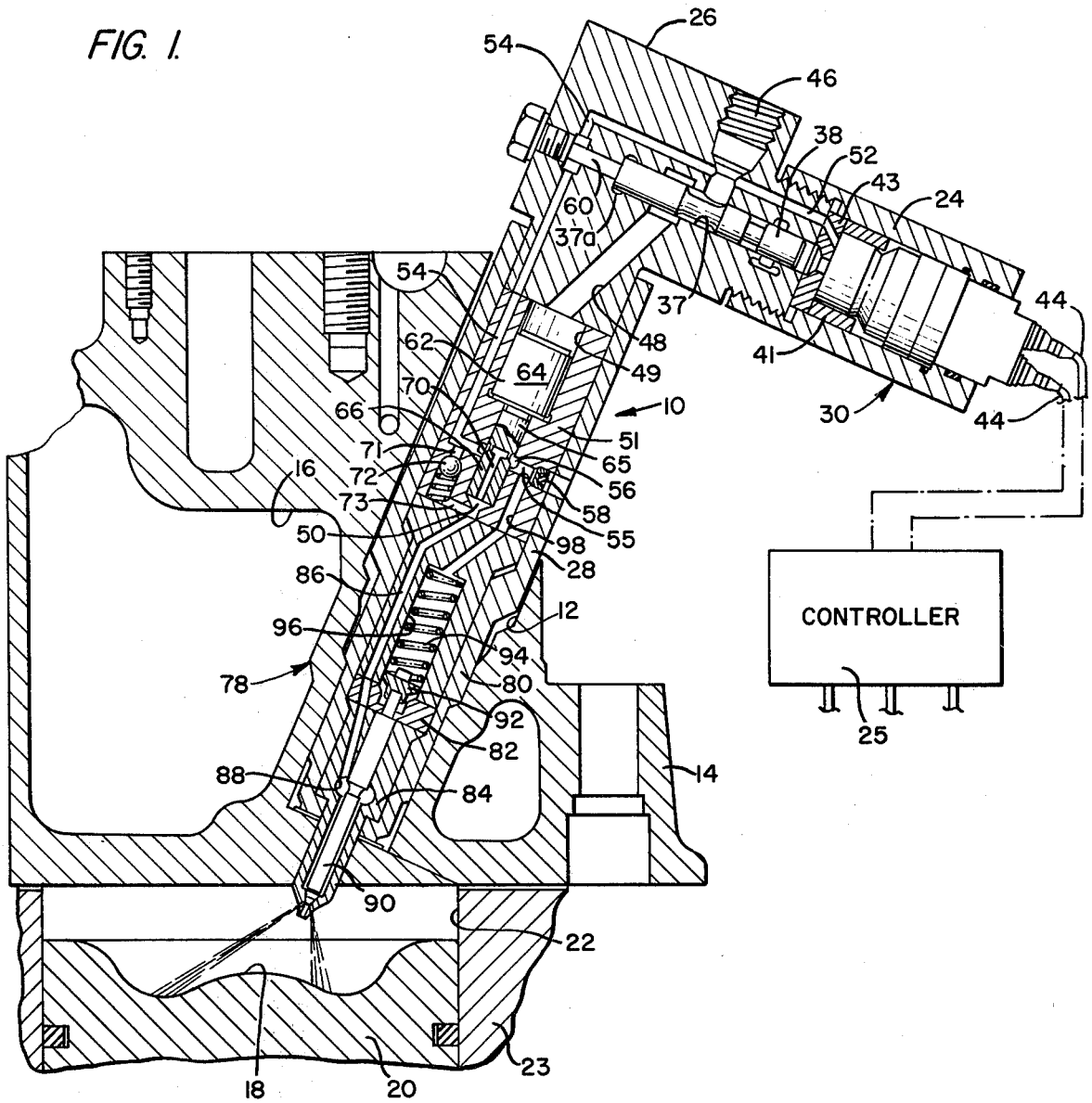
FIG. II.
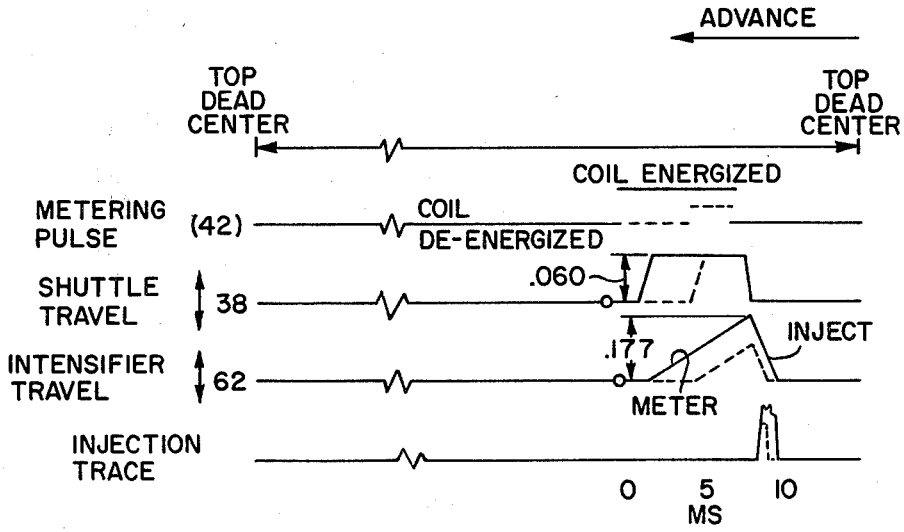

METER

INJECT

METER

INJECT

ELECTRONICALLY CONTROLLED, SOLENOID OPERATED FUEL INJECTION SYSTEM

BACKGROUND OF THE INVENTION

1. Field of Invention

This invention relates generally to fuel injection systems, and more particularly to electronically controlled, solenoid operated fuel injection systems adapted for use with Diesel engines.

2. Prior Art

Diverse types of fuel injection systems have been utilized to deliver the precise amounts of fuel under high pressure necessity for optimum performance of Diesel engines. The systems shown in U.S. Pat. Nos. 3,908,621, granted Sept. 30, 1975, to Russell B. Hussey, and 3,952,711, granted Apr. 27, 1976 to John A. Kimberley et al, rely upon an engine generated variable "common rail," high pressure fluid to drive the fuel injectors in timed sequence. A central fuel metering and distributing apparatus delivers metered quantities of fuel to the injectors, which are actuated by an electric signal from a timing signal generator.

Another fuel injection system is shown in U.S. Pat. No. 3,835,829, granted Sept. 17, 1974, to Heinz Links. This system includes a reciprocating pump piston 19 performing its injection strokes by virtue of hydraulic pressure intermittently applied thereto in a controlled manner. Between injection strokes, the pump work chamber 43 is charged with pressurized fuel through a supply valve 21 and a throttle 22, which causes the charging period to be significantly longer than the injection period.

Another pertinent prior art fuel injection system is shown in U.S. Pat. No. 3,516,395 granted June 23, 1970 to Jacques Bassot et al. The fuel injection system in Bassot et al includes a fuel injection unit including a cylinder 8 and piston 7 of relatively large diameter dispose coaxially with, and above, a cylinder 6 and piston 5 of relatively small diameter. A pump 2 and an electronically controlled valve 3 supply a precisely measured charge of fuel to the small cylinder. Subsequently, in response to a signal from an electronic controller 12, fuel at supply pressure is admitted to the chamber above piston 7 to drive the piston 5 downwardly; such downward movement materially raises or amplifies the pressure level in the fuel in cylinder 6 and forces same to overcome the closing pressure in nozzle 14. The metered quantity of fuel is then discharged into the combustion chamber of an internal combustion engine.

A more compact electronically controlled, solenoid operated fuel injection system, in which several of the components including the solenoid, an intensifier piston, and the discharge nozzle are all encased in a common housing is shown in U.S. Pat. No. 3,921,604, granted Nov. 25, 1975 to Heinz Links. The Links '604 patent discloses a reciprocating pump piston 25 driven by a servo piston 24 which is intermittently exposed to fuel pressure to cause the pump piston to execute its delivery (injection) strokes. Between two delivery strokes, the pump work chamber 52 is charged with pressurized fuel through a throttle 26 while the pump piston executes its return stroke. The throttle 26 defines a permanently set flow passage so dimensioned as to substantially lengthen the charging period, with respect to the injection period, for the cycle of operation. The admission of fuel to the servo-piston is controlled by the switching positions of valve plunger 18, which, in turn is exposed to pressurized fuel for periods controlled by solenoid valve 17. The charging periods take place during the variable, de-energized periods of the solenoid valve.

Although the Links '604 represents a fuel injection system that is far superior to known hydraulically operated systems, as well as to other known electronically controlled systems, certain shortcomings are discernible. For example, the solenoid for each fuel injector in the Links '604 system is energized during most of the cycle of operation and this may lead to solenoid overheating, particularly at low engine speeds. Also, the valve plunger 18 in Links '604 is biased by a spring 19 against the force of supply pressure; if the spring breaks, or exhibits fatigue, during continued usage it will adversely influence the response of the valve plunger to the supply pressure. Perhaps, even more significantly, the fixed orifice 26 in the charging bore 48 affects the speed of the fuel supply into pump work chamber 52; the fixed orifice can not be adjusted to account for manufacturing tolerances and other differences among the individual injectors in the set of injectors utilized in a fuel injection system.

Another electronically controlled, solenoid operated fuel injection system is disclosed in U.S. Pat. No. 4,069,800, granted Jan. 24, 1978 to Fumio Kanada et al. This system suffers from operational deficiencies such as those encountered with the system shown in Links '604, e.g. the utilization of a spring 64 to bias the spool valve 62 to one end of a spool valve chamber. The bias of the spring reduces the sensitivity of the spool valve 62 to variations in the supply pressure, and augments the inertial effects acting upon the spool valve. This increases the response time necessary for the spool valve to be shifted to allow communication between the inlet port and the servo-chamber 54.

OBJECTS AND ADVANTAGES OF THE PRESENT INVENTION

Taking into full account the shortcomings of the representative known fuel injection systems discussed above, the present fuel injection system attempts to realize a simpler, more compact, fuel injection system that can be electronically controlled with increased precision. Furthermore, the present fuel injection system is ideally suited to discharge fuel through the injection nozzle at increased flow rates and with pressures reaching at least 15,000 psi and, perhaps, to 20,000–30,000 psi. The increased flow rates and amplified pressures will ensure better combustion and fewer pollutants from known Diesel engines.

It is an object of the present invention to provide a simple method for individually calibrating each injector within a fuel injection system relative to a signal of fixed duration from an electronic controller. The individual calibration may be achieved by manually adjusting a needle valve, or other variable orifice, relative to a strategically located return flow passage.

It is a further object of the present invention to utilize an electronicallly controlled, solenoid operated fuel injector wherein the solenoids are energized for but a fraction of the cycle of operation of the system, thereby reducing solenoid heating problems and reducing current demands therefor.

It is another object of the present invention to achieve a fuel injection system that employs a plurality of similar solenoid operated fuel injectors that are compatible with a single conventional electronic controller. The duration of a signal from the controller regulates the amount of fuel collected in a metering chamber in each injector during the metering phase of the cycle of operation. The fuel collected is subsequently dispensed through a nozzle into the combustion chambers of the internal combustion engine when the signal from the controller to each solenoid is terminated. Additionally, each solenoid has a travel of but a minute fraction of an inch, and thus responds very rapidly to the signals from the electronic controller.

It is yet another object of the present invention to provide a solenoid operated, electronically controlled fuel injection system where the volume of fuel to be dispensed during the injection phase for each injector is precisely and variably accumulated in a metering chamber during the preceding metering phase. The metered fuel is subsequently discharged by the injection piston, which amplifies the pressure therein during the next phase of the cycle of operation.

Furthermore, another object of the invention is to utilize shuttle valves that reliably govern the flow pressurized fuel at supply pressures of 3,000–5,000 to an intensifier piston. The intensifier piston, in turn, amplifies the pressure within the fuel to a level several times greater than that produced by the high pressure pump. The amplified pressure level overcomes the combined closing force of a spring and the supply pressure present in the spring cavity of the injector nozzle, and opens the nozzle to discharge a finely atomized spray of fuel.

Another object is to provide a shuttle valve that is more responsive and sensitive to changes in hydraulic pressure. The shuttle valve responds almost instantaneously to the differences in pressure applied to the opposite faces of the shuttle valve because no biasing springs are present.

Also, another object of the invention is to design a fuel injection system wherein a passage in the intensifier piston quickly relieves pressure build-up and insures that the fuel injector functions properly. Yet a further object is to provide an adjustable needle valve, or other variable restriction, in a return conduit disposed between the shuttle valve and an actuating chamber, so that the rate of flow from the intensifier piston to the fuel reservoir can be varied during the metering phase of the cycle of operation.

Other objects and advantages attributable to the present fuel injection system will become apparent to the skilled artisan when the appended drawings are construed in harmony with the ensuing specification.

DESCRIPTION OF THE DRAWINGS

FIG. 1 is a vertical cross-sectional view of an electronically controlled fuel injector constructed in accordance with the principles of the instant invention, such injector being secured within the cylinder head of an engine;

FIG. 11 is a timing chart correlating the events in the cycle of operation of the fuel injector system to engine events.

DESCRIPTION OF THE INVENTION

Figure 3:
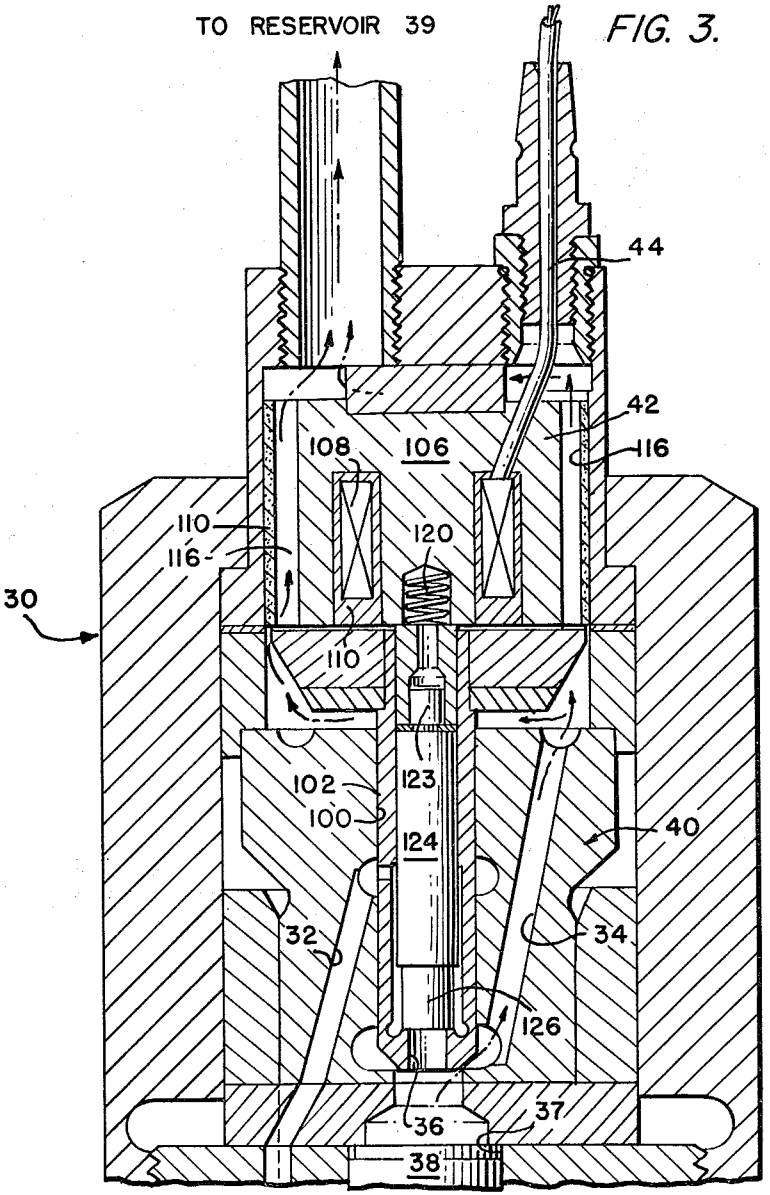
FIG. 3 is a view similar to FIG. 2, but showing the solenoid in its energized condition.

Turning now to the drawings, FIG. 1 reveals the key components of an electronically controlled, solenoid operated fuel injection system including an injector 10 secured within an opening 12 in the cylinder head 14 of an internal combustion engine, such as a Diesel engine. A coolant passage 16 is also formed in the cylinder head, of which only a fragment is shown. The injection system discharges finely atomized fuel under high pressure directly into a cavity 18 located in the upper end of piston 20 as the piston approaches the limit of its upward travel within the combustion chamber 22 in the engine block 23.

Although only one fuel injector is shown, it is noted that the overall fuel injection system includes several fuel injectors of identical construction, one injector being provided for each combustion chamber 22 within the engine block 23 with an electronic controller 25 for supplying control signals to the injectors in an appropriate sequence.

The fuel injector 10 includes a first housing section 24, a second L-shaped housing section 26, and a third elongated housing section 28 which is seated within opening 12 in the head 14 of the engine. The housing sections are screw-threaded together and the injector assumes an L-shape.

Figure 2:
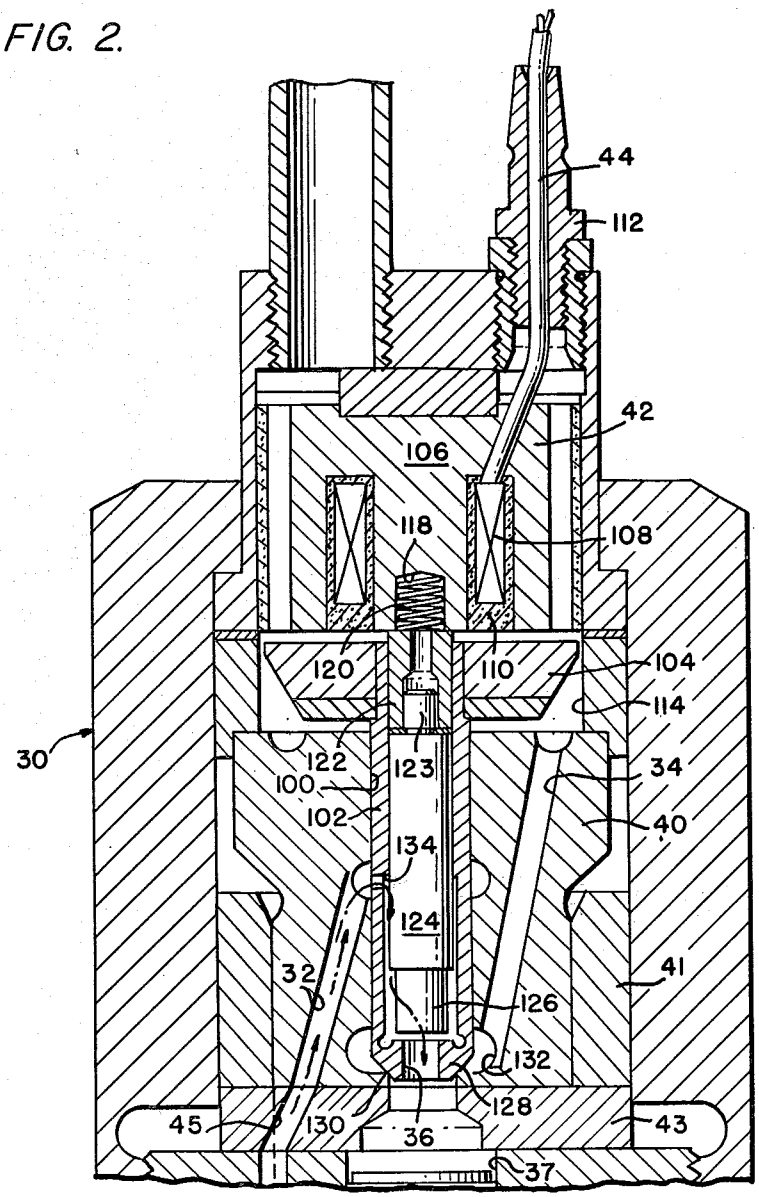
FIG. 2 is a cross-sectional view, on an enlarged scale, of the solenoid operated multi-way valve utilized within the fuel injector of FIG. 1, such view showing the solenoid in its normal, de-energized condition.

A three-way valve 30 is situated within housing section 24, and as shown in FIGS. 2 and 3, the valve includes a solitary inlet passage 32 and a pair of outlet passages 34, 36. The fluid flowing through inlet passage 32 and then into outlet passage 36 enters a shuttle chamber 37 and influences the operation of the shuttle valve 38 situated within the chamber 37 in housing section 26. Outlet passage 34 returns fluid from chamber 37 to the fuel reservoir 39. The valve 30 comprises, inter alia, a pilot valve 40 and a solenoid 42 that is energized via leads 44. The state of the solenoid, i.e., energized or de-energized, determines whether a flow path will be established between inlet passage 32 and shuttle chamber 37 via outlet passage 36, or between shuttle chamber 37 and the outlet passage 34 which leads to the fuel reservoir. The pilot valve 40 is retained in position by spacer 41 and stop plate 43. The stop plate has a passage 45 which is aligned with the inlet passage 32 of valve 40. Additional structural details of valve 30 are shown in FIGS. 2 and 3 and will be described at greater length at a later point in the specification.

Returning again to FIG. 1, shuttle valve 38 is shifted within chamber 37 in housing section 26 in response to the application of fluid pressure to the axial ends of the valve. The valve 38, which assumes the form of a spool valve in the preferred embodiment, includes three cylindrical segments interconnected by grooves of reduced diameter. The grooves, when disposed in the path of fluid flow, permit fuel entering inlet port 46 to flow around and past the valve 38 and through conduit 48 to enter the upper end of actuating chamber 49 within intensifier casing 51 retained within housing section 28, as shown in FIG. 1. However, when the shuttle valve 38 is shifted out of the position shown in FIG. 1, the cylindrical segments fit snugly against the wall defining chamber 37 and prevent fuel flowing into conduit 48, the fuel bleeds into a return conduit which leads to an outlet port (not shown in FIG. 1 but visible in FIG. 6) and returns to the fuel reservoir 39. The shuttle valve assumes one position during the metering phase of the operation of the fuel injector, and assumes the other position during the injection phase.

A first branch conduit 52 extends between the inlet port 46 and the passage 45 in stop plate 43 which leads to the inlet passage 32 of pilot valve 40, while a second branch conduit 54 extends from the inlet port 46 into the intensifier casing 51 and opens into a cross-hole 55 having an enlarged annulus formed therein. A plug 58 seals the entrance of cross-hole 55, which is drilled through the housing. A minor piston 60 is situated at one end of chamber 37 in direct communication with branch conduit 54, and the fluid pressure continuously applied against the working face of piston 60 influences the movement of shuttle valve 38 within chamber 37 in opposition to the intermittent fluid pressure present in chamber 37. The area of the working face of the piston 60 is but a fraction of the area of the working face of shuttle valve 38, so that the valve 38 will be influenced by piston 60 only under certain operating conditions; i.e., when fluid pressure is not present in chamber 37 at supply levels.

An intensifier piston 62 is disposed for movement within intensifier casing 51 which is situated within housing section 28. The intensifier piston comprises an enlarged upper cylinder 64, an intermediate cylinder 65 and a smaller lower cylinder 66. The components that comprise the intensifier piston 62 fit snugly within the contours of the interior of the intensifier housing 51, and move therewithin. The lower cylinder 66 is but one-fifth the area of the upper cylinder 64, in the preferred embodiment, and a T-shaped passage 70 is defined in the interior of cylinder 66. The configuration of the intensifier piston 62 is clearly shown in FIGS. 7 and 8.

Passage 70 is normally situated out of alignment with the cross-hole 55 that opens into branch conduit 54; however, when the intensifier piston 62 is moved downwardly in response to pressurized fluid acting upon the upper end of cylinder 64, lower cylinder 66 is shifted so that communication is established between the conduit 86 and cross-hole 55. A check valve 72, which may assume the form of a ball valve, is disposed at the juncture of conduits 71 and 73, and is urged by spring 74 toward a valve seat 76. The check valve blocks return flow from the metering chamber 50 to conduit 54 allowing pressure to be built up by the intensifier piston during the injection phase of the cycle of operation. During the metering phase, the check valve only retards the flow of pressurized fuel toward the metering chambers. Although actuating chamber 49 and metering chamber 50 are identified as two separate chambers with distinct functions ascribed thereto, the chambers may, in fact, be a single cavity with the intensifier piston isolating the chambers from one another.

The nozzle 78 projects through an opening in the lower end of housing section 28, and discharges fuel, under pressure in excess of 15,000 psi, in a radial pattern into the cavity 18 in the upper end of piston 20. Nozzle 78, which is situated in housing section 28 beneath intensifier casing 51, comprises a spring housing 80, a stop plate 82, and a nozzle body 84. A conduit 86 extends axially from the lower end of metering chamber 50 beneath lower cylinder 66 of the intensifier piston 62 through plate 82 to terminate in an annular cavity 88 within nozzle body 84.

A needle 90 extends through the nozzle body 84, and the upper end of the needle is received in retainer 92. The retainer is biased downwardly by spring 94 that is seated in chamber 96 within housing 80 to press the lower end of the needle against a seat formed on the interior of the nozzle body 84. The force of the spring is augmented by the supply pressure of the fuel entering inlet port 46, for the pressurized fuel flows through conduit 54 into cross-hole 55 and annulus 56 and thence into conduit 98. Conduit 98 extends axially below cross-hole 55 and communicates with chamber 96. The chamber 96 is always in communication with inlet port 46 and receives pressurized fuel therefrom. When the needle 90 is seated in response to the forces of the spring and the pressurized fuel, flow through the orifices in the nozzle body 84 is prevented. The nozzle 78 is known as a differential pressure nozzle, for the force required to open same exceeds the force needed to close same; this characteristic reduces dribble from the nozzle.

FIG. 2 depicts the structural configuration of the three-way valve 30 in its normal, unactuated condition. A representative three-way valve is known as the Sofredi valve, which was developed by Sofredi/Sopromi—a private French firm. Technical information relating to the Sofredi/Sopromi valve is now available through ANVAR, an agency of the French government. The pilot valve 40 is operated by solenoid 42 to selectively divert the fuel flow (1) from inlet passage 32 to outlet port 36 and thence to the shuttle chamber 37, or (2) from shuttle chamber 37 into outlet passage 34 and thence to the fuel reservoir. The pilot valve 40 is secured within the open end of housing section 24 which retains the solenoid 42 in fixed relation to the pilot valve. A central passage 100 extends axially through the pilot valve, and a valving sleeve 102, which projects downwardly from the solenoid 42, fits snugly within the passage 100.

The upper end of valving sleeve 102 fits within an aperture in armature 104, which, as shown in FIG. 2, is normally disposed a minute fraction of an inch from the electromagnetic core 106 of the solenoid 42. The coils 108 and core 106 are encased in a potting compound 110, and the coils of the solenoid are energized via leads 44 which are attached to two terminals 112. The metallic armature, which has a tapered profile, can move vertically within an annular chamber 114 which is defined between the upper end of the pilot valve 40 and the lower end of the solenoid 42. As shown, the compound 110 could fill the housing, and holes could be drilled axially therethrough. Alternatively, flow channels 116 could be molded, or otherwise formed, in potting compound 110 by the formation of flats on the periphery of the compound so that the compound does not completely fill the housing of the solenoid operator (not shown).

A counter-bored cavity 118 is centrally located in the lower end of the electromagnetic core 106 and a spring 120 is positioned in the cavity. Brass stop 122, which fits over lug 123 atop stepped piston 124, is biased downwardly by the spring. The piston 124 depends below solenoid 42 and fits snugly with sleeve 102. A nose 126 of reduced diameter is formed at the lower end of piston 124, and the internal diameter of the sleeve 102 is also increased along the lower half of the sleeve. Thus, an annular space is defined between the lower end of the piston and the sleeve 102 and surrounds the fixed piston; the fuel received within such space exerts an upwardly directed force upon piston 124 and stop 122.

Sleeve 102, which moves upwardly as armature 104 is attracted toward the energized coils 108 of the solenoid 42, terminates in a conical projection 128 which cooperates with a valve seat 130 defined at the entrance of annular chamber 132 in pilot valve 40. An aperture 134 is located in the side of sleeve 102, and such aperture communicates directly with the inlet passage 32 of the pilot valve to receive the fuel introduced into the injector via inlet port 46, passage 45 in plate 43 and inlet passage 32.

A comparison of FIGS. 2 and 3 reveals the manner in which the three-way valve 30 is adjusted in response to the energization, or de-energization, of solenoid 42 by electronic controller 25 (FIG. 1) to selectively divert the fuel flow (1) from inlet passage 32 through outlet passage 36 into shuttle chamber 37, or (2) from chamber 37 through outlet passage 34 and into the fuel reservoir 39. Outlet passage 34 returns the fuel to the fuel reservoir, while the unblocking of the outlet port 36 allows the fuel to flow into the shuttle chamber 37 to influence the operation of shuttle valve 38. FIG. 2 shows the solenoid 42 in its normal unactuated condition, with projection 128 of valving sleeve 102 pressed firmly upon seat 130. Consequently, pressurized fuel from inlet port 46 flows through the plate 43 and into the inlet passage 32 and thence exits through outlet passage 36 into shuttle chamber 37. The flow of fuel when the solenoid is de-energized is shown by directional arrows in FIG. 2, while the flow of fuel when the solenoid is energized is shown by directional arrows in FIG. 3.

Figure 4:
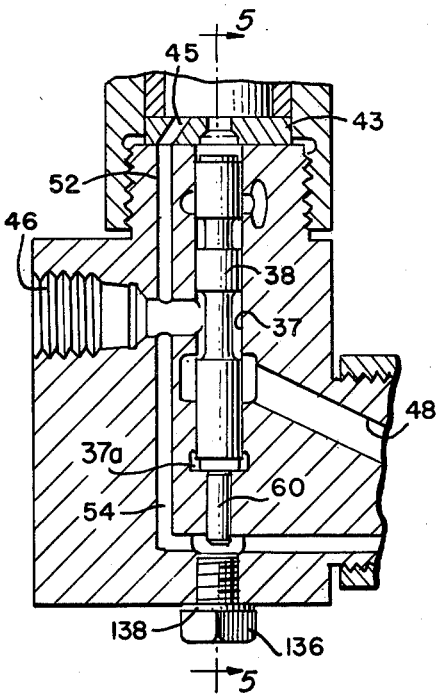
FIG. 4 is a cross-sectional view, on an enlarged scale, of the shuttle valve, minor piston, and a fragment of the multi-way valve employed within the instant fuel injector.

FIG. 4 is a cross-sectional view of the shuttle valve chamber 37, the shuttle valve 38, the minor piston 60, and the inlet port 46 which is connected to the source of pressurized fuel; such components are visible in FIG. 1 but are shown in FIG. 4 on an enlarged scale. The stop plate 43, which absorbs the impact of shuttle valve 38, is also visible, as are portions of branch conduits 52 and 54 and a segment of conduit 48 which communicates with actuating chamber 49 and the upper cylinder 64 of the intensifier piston 62. The shuttle chamber 37 with its varied shape of cylindrical sections and annular enlargement is drilled, bored or otherwise machined into the intermediate segment 26, and then a plug 136 with a washer 138, is screwed into the open end of the chamber to seal same. Obviously, the plane of the view of FIG. 4 is rotated counterclockwise from the plane of FIG. 1.

Figure 5:
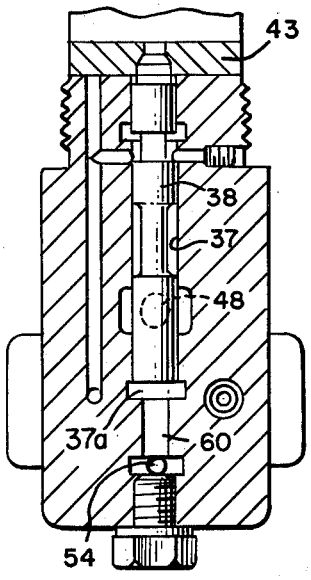
FIG. 5 is a cross-sectional view, of the same components, taken along line 5—5 in FIG. 4; however, the components are depicted during the injection phase of the cycle of operation in FIG. 4, but are depicted during the metering phase in FIG. 5.

FIG. 5 is a cross-sectional view similar to FIG. 4; however, whereas FIG. 4 shows the shuttle valve 38 to its lowered position approaching the bottom of shuttle chamber 37, FIG. 5 shows the valve 38 in its raised position approaching the stop plate 43 situated below the multi-way valve 30. For reasons that will become more readily apparent later, the shuttle valve 38 is in its injection phase of the cycle of operation in FIGS. 1 and 4, while the same valve is in its metering phase in FIG. 5. The movement of the shuttle valve is regulated by the intermittent application of pressurized fluid to the upper working face of the shuttle valve 38, and the constant application of pressure to the minor piston 60.

Figure 6:
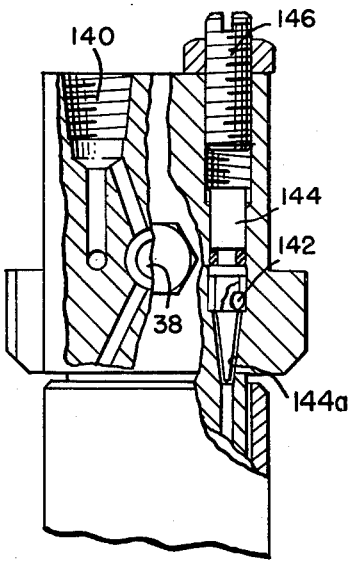
FIG. 6 is an elevational view of a portion of the housing of the fuel injector, such view having fragments broken away to reveal a needle valve and portions of the return flow conduits.

FIG. 6 depicts the outlet port 140 that allows the pressurized fuel that is blocked by shuttle valve 38 to be returned to the reservoir 39 when the valve is moved upwardly during the metering phase. The outlet port 140 allows the pressurized fuel that is present in the actuating chamber after the injection phase is terminated to be displaced and returned to the fuel reservoir via a tortuous, intersecting path including cross hole 142. The tip of needle valve 144 is disposed in operative relation to tapered valve seat **144*a*, and a threaded screw 146 enables the tip to be adjusted relative to the seat to thereby vary the rate of flow of the fuel returning to reservoir 39. O-rings may be positioned about the valve to seal same. The ability to trim the rate of flow enables each injector in the fuel injection system to be individually calibrated relative to the controller 25. The location of the variable orifice 144, 146 in the return conduit between the actuation chamber 49 and the shuttle chamber 37 further enhances the effectiveness of the calibration technique for the restriction introduces but an insignificant pressure drop. FIG. 6 also suggests that the fuel trapped in the enlarged annuli, such as annulus 37*a*, that are an integral part of shuttle chamber 37, is also bled into outlet port 140 during the metering phase of the cycle of operation. The paths of all of the return flows run together before reaching the common outlet port 140. Other modes of bleeding the trapped fuel back through port 140 and/or to reservoir 39 may also be used with equal success. A fragment of valve 144 is broken away to reveal cross-hole 142**.

Figure 7:
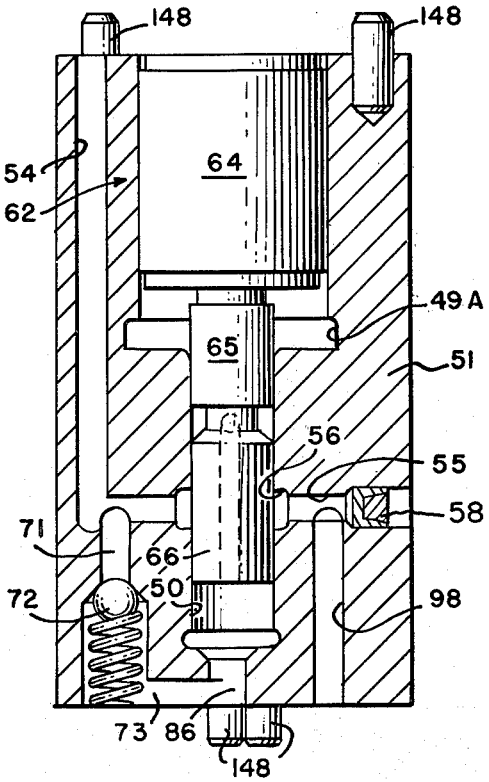
FIG. 7 is a cross-sectional view of the intensifier assembly employed within the fuel injector, such view showing the intensifier assembly during the metering phase of the cycle of operation.
Figure 8:
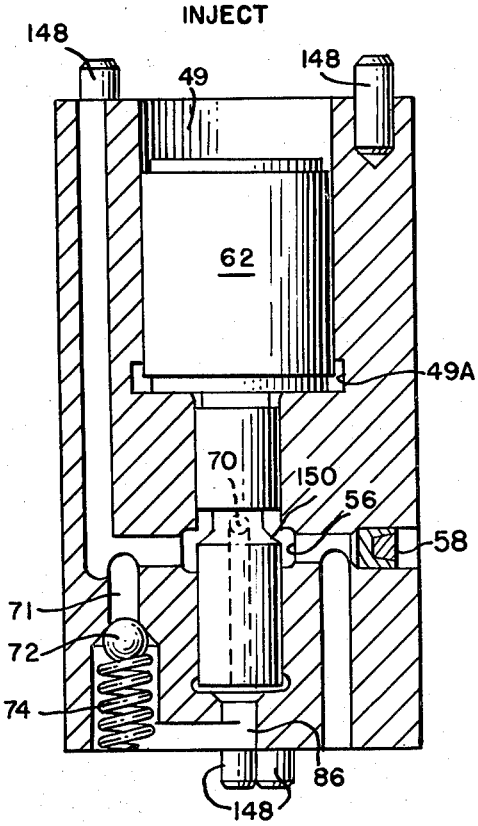
FIG. 8 is a view similar to FIG. 7, but showing the intensifier piston at the end of the injection phase of the cycle of operation.

FIGS. 7 and 8 show on an enlarged scale, the intensifier housing 51, and the components located therein. FIG. 7 shows the components in the position assumed during the metering phase of operation, while FIG. 8 shows the components assumed during the injecting phase of operation.

Pins 148 extend from the upper and lower surfaces of the intensifier housing, and the pins fit into apertures (not shown) in the adjacent sections of the housing to insure proper alignment. The upper cylinder 64 of intensifier piston 62 moves within actuating chamber 49, while the lower cylinder 66 moves within metering chamber 50. The limit of downward movement of the intensifier piston is defined by the lower face of cylinder 64 contacting the base of the enlarged annulus **49*a* in the actuating chamber, as shown in FIG. 8. The lower face of cylinder 66 approaches, but does not contact, the base of the enlarged annulus 49*a* in the metering chamber, also as shown in FIG. 8. The larger area at the bottom of chamber 49** better sustains the impact of the intensifier piston.

The upward movement of cylinder 66 increases the volume within the metering chamber 50 into which pressurized fuel is introduced during the metering phase of the cycle of operation. The limit of upward movement is defined by the upper end of the upper cylinder of the intensifier piston reaching the top of actuating chamber 49 and abutting against the lower surface of the intermediate section 26 of the injection housing. FIG. 7 depicts the intensifier piston at its limit of upward movement, while FIG. 8 depicts the intensifier piston at its limit of downward movement. By varying the duration of the electrical signals delivered by controller 25 to the solenoid of the multi-way valve 30, the extent of upward movement of the cylinder 66 within the metering chamber 50 can be adjusted to meter to admit thereinto the desired variable quantity of pressurized fuel. The metered fuel will subsequently be injected into the internal combustion engine at a later point in the cycle of operation.

The T-shaped passage 70 that extends axially through the lower cylinder 66 of the intensifier piston is also seen in FIGS. 7 and 8. In FIG. 7, the passage 70 has moved upwardly above cross-hole 55, and any fuel escaping therefrom is trapped in the housing between intermediate cylinder 65 and lower cylinder 66. Flow in cross-hole 55 is not impeded by lower cylinder 66, for the flows enters annulus 56 and flows around the cylinder on its way to axial conduit 98 which leads into the spring cavity 96 in the housing 80. In FIG. 8, the undercut 150 associated with passage 70 establishes communication between the passage and the annulus 56. Any fuel forced out of the passage will enter the annulus, and rapidly flow into cross-hole 55 and thence into axial conduit 54. Spring cavity 96 always receives the pressurized fuel flowing in cross-hole 55, regardless of the position of intensifier piston 62.

CYCLE OF OPERATION

Figure 10:
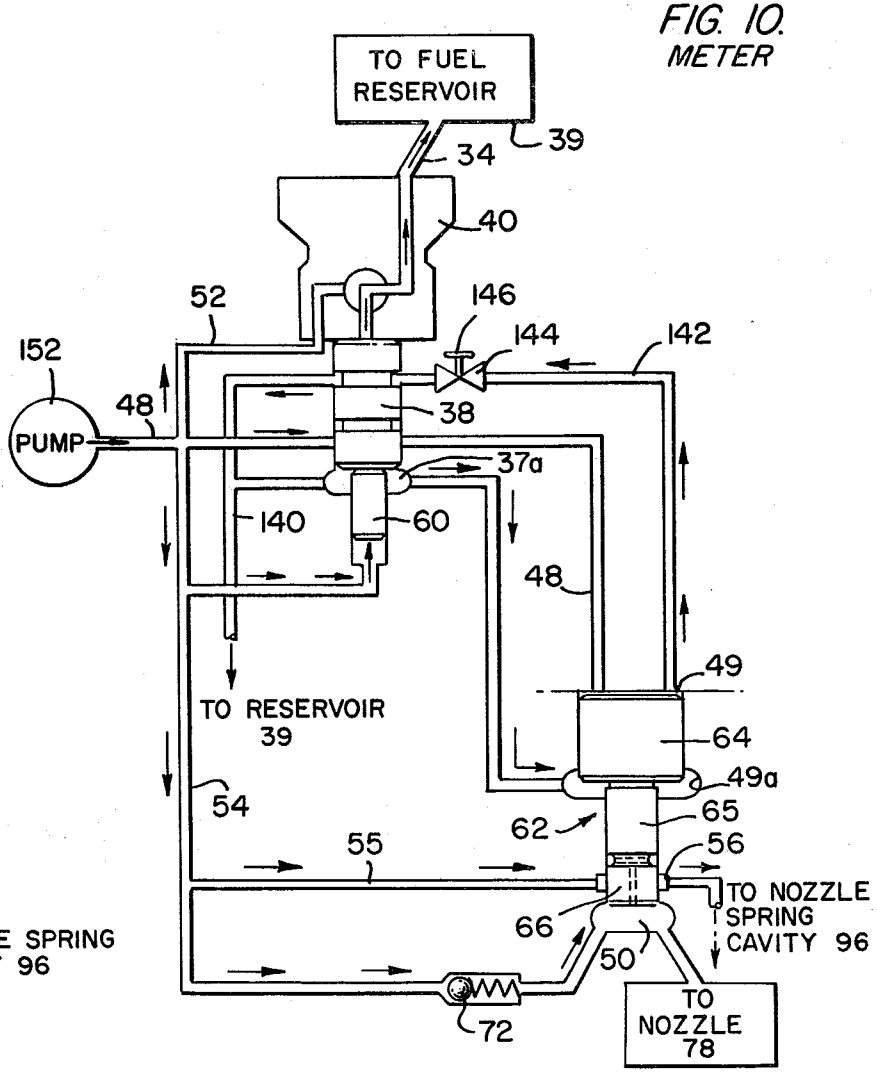
FIG. 10 is a similar circuit diagram schematically representing the metering phase for the system.
Figure 9:
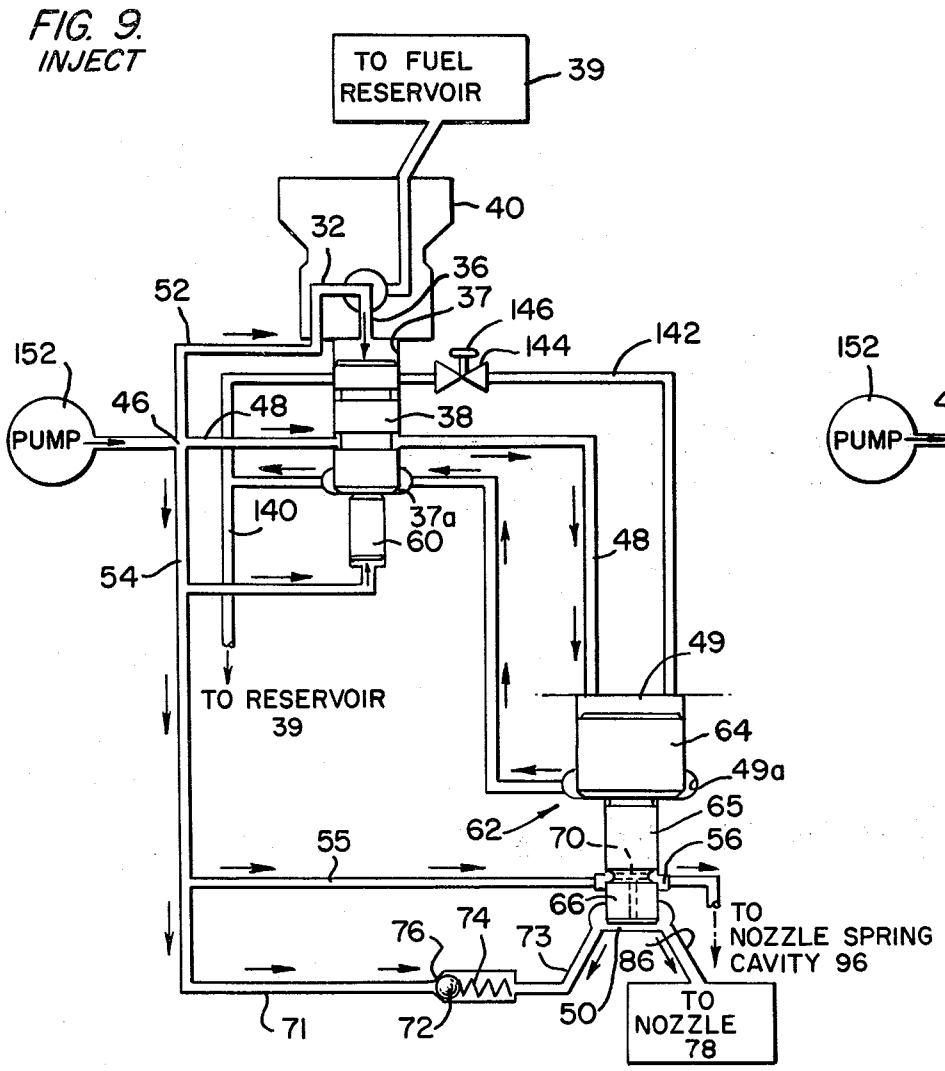
FIG. 9 is a circuit diagram of the fuel injector system of FIG. 1; such diagram schematically representing the end of the injection phase for the system.

The salient functional characteristics of the fuel injection system shown in FIGS. 1–8 can best be appreciated by a detailed description of its cycle of operation with particular reference to FIGS. 9–10. As a reference point, let us assume that the cycle begins when a transfer pump (not shown) withdraws fuel from the fuel reservoir 39 and supplies same to the high pressure pump 152. Pump 152 pressurizes the fuel and constantly feeds same via inlet port 46 into three conduits 48, 52, 54 extending through the housing for the injector. Since solenoid 42 is normally de-energized, as shown in FIG. 2, the flow of pressurized fuel in conduit 52 flows through the stop plate 43 into inlet passage 32 of the multi-way or pilot valve 40, through aperture 134 in valving sleeve 102, and then passes through outlet passage 36 into shuttle chamber 37. The upper working face of shuttle valve 38 is thus exposed to the pressurized fuel at supply pressure, and the valve moves downwardly within chamber 37 until seated securely on the bottom thereof, as shown in FIG. 4. When the shuttle valve 38 is seated on the bottom of the chamber 37, the groove between the center and lower segments permits pressurized fuel to pass thereabout and enter actuating chamber 49 to apply pressure to the upper working face of intensifier piston 62. The downward movement of shuttle valve 38 brings the upper cylindrical segment of the valve into blocking relationship with the cross-hole 142 (see FIG. 6) so that any return flow from chamber 49 through the adjustable needle valve 144 can not reach the reservoir downstream from the valve 38. The intensifier piston 62 is also forced downwardly until the piston is bottomed in the annulus at the longer end of the chamber 49 (see FIG. 8).

At the same time that pressurized fuel is flowing through conduit 52, pressurized fuel is flowing in conduit 54. Although the pressurized fuel acts upon the bottom working face of minor piston 60, such upwardly directed force is unable to overcome the force acting upon the upper working face of shuttle valve 38, for the area of the valve is several times greater than the area of the minor piston. The pressurized fuel in conduit 54 continues downstream, flows into cross-hole 55 and annulus 56 and around the intensifier piston, and enters the spring cavity to augment the forces acting upon retainer 92 to seat the needle 90.

The pressurized fuel in conduit 54 also flows into branch conduit 71. Ball check valve 72 is normally urged by spring 74 toward seat 76. During the metering phase, the check valve 72 is pushed away from its seat 74 by the force of the pressurized fuel, as suggested by FIG. 10. During the injection phase, as the intensifier piston 62 is driven downwardly, the check valve is forced against seat 76 to (1) seal off the chamber 50 and allow the fuel contained therein to be greatly amplified in pressure and, (2) prevent the pressurized fuel from escaping upstream into conduit 54. FIG. 9 suggests these relationships.

The injection phase of the cycle of operation occurs as the intensifier piston 62 is forced downwardly within metering chamber 50 by the application of pressurized fuel to the top of the piston. The duration of the injection phase corresponds to the travel time for the intensifier piston 62 to move from its initial, elevated position in the actuation chamber 49, as suggested by FIG. 10 until it reaches the bottom of said chamber 49, as suggested by FIG. 9. As the intensifier piston 62 is driven downwardly by the pressurized fuel, at supply pressure, acting upon its upper working face, the pressure upon the fuel in the chamber 50 is amplified significantly due to the differences in the areas of the upper 64 and lower 66 cylindrical members of the piston 62. The area of the upper cylinder, for example, might be four times greater than the area of the lower cylinder. Thus, if pressurized fuel at 5000 psi is applied to the upper cylinder, the lower cylinder will be exerting a quadrupling force upon the fuel in the chamber 50, raising the pressure level to 20000 psi. The pressurized fuel from chamber 50 flows into conduit 86 and annulus 88 in the nozzle body; since the amplified pressure level is at 20,000 psi, the resultant hydraulic force overcomes the combined forces of the spring 94 (e.g. 30 psi) and the pressurized fuel (e.g. 5000 psi) in cavity 96 that normally maintain the needle 90 in closed position. The net effect of the greater pressure level in annulus 88 forces the needle 90 away from its seat and the pressurized fuel is discharged in a minute atomized spray directly into a combustion chamber 22 in the engine block. FIG. 9, it will be noted, shows the intensifier piston 62 at the limit of its downward travel in chamber 49, the solenoid de-energized, and shuttle valve 38 at the bottom of chamber 37. To prevent fuel from being trapped in annulus **49*a* at the bottom of chamber 49 and annulus 37*a* at the bottom of chamber 37, these annuli are connected together, in series, and vent through outlet port 140 into reservoir 39**. The flow of pressurized fuel through the various conduits is indicated by the directional arrows.

In contrast to FIG. 9, FIG. 10 shows the components of the fuel injection system in the positions assumed during the metering phase of the cycle of operation. To initiate the metering phase, an electronic signal is delivered to coils 108 of solenoid 42 which attract armature 104, as shown in FIG. 3, thereby moving valving sleeve 102 relative to plunger 124. The pressurized fuel in conduit 52 and inlet passage 32 is blocked by the nose 126 of plunger 124 sealing outlet passage 36, while a flow path is established from shuttle chamber 37 past valve seat 130, into outlet passage 34 and thence to fuel reservoir 39.

The pressurized fuel, in conduit 54 is continuously applied to the lower working face of minor piston 60. Since the pressurized fuel in conduit 52 is blocked and thereby does not act upon the upper working face of shuttle valve 38, the minor piston is able to drive the larger shuttle valve upwardly. The upward movement of valve 38 towards plate 43 forces the fuel in the upper end of chamber 37 through outlet passage 34 to return to the fuel reservoir 39. The shuttle valve 38 moves upwardly until the annulus between the upper and middle sections of the valve is aligned with outlet passage 142 and the lower section blocks flow in conduit 48 so that the pressurized fuel is not supplied to the upper end of intensifier piston 62. The pressurized fuel in crosshole 55 and annulus 56 flows around intensifier piston 62, regardless of its position, and communicates with spring cavity 96.

As the intensifier piston 62 moves downwardly during the injection phase and the pressure level of the fuel in chamber 50 is amplified, the amplified pressure seats the ball valve 72 against its seat 76 and prevents amplified pressurized fuel in chamber 50 from flowing in the reverse direction past valve seat 76 into conduits 71 and 54. At the end of the injection phase, the amplified pressure level is reduced very quickly within annulus 88 and the nozzle valve, thus sharply terminating the fine atomized spray of fuel. This is accomplished by having the pressurized fuel collected in annulus 88, etc. expand and displace upwardly by the needle 90 as same returns to its normal unactuated position. The fuel moves upwardly through conduit 86, through T-shaped passage 70 and into the annulus defined between cylinders 65 and 66 of the intensifier piston 62, and into annulus chamber 56. The quick release of the pressurized fuel via the annulus to annulus communication insures fuel injector operation that is precise and avoids dribble through the nozzle. Since the pressurized fuel is blocked by valve 38 before reaching the larger cylinder 64 at the upper end of intensifer piston 62, the pressurized fuel acting upon the lower working face of cylinder 66 is able to drive the piston 62 upwardly. As the piston 62 travels upwardly, it forces the fuel collected in the chamber 49 above the piston into outlet passage 142. The rate of flow in passage 142 as the fuel returns to reservoir 39 is varied by adjusting needle valve 144 relative to its seat. By virtue of its strategic location between actuating chamber 49 and the shuttle chamber 37, the adjustable orifice controlled by the needle valve 144 is capable of adjustment over a range of flow conditions; this capability can be used to adjust the performance of each injector relative to a control signal of a predetermined duration. In effect, each injector can be "fine tuned," and the relatively large flow in the return conduit 142 allows for considerable latitude in the range of adjustment.

The extent of upward movement of piston 62 is directly related to the duration of energization of solenoid 42. If solenoid 42 is energized for its entire period of operation, i.e., a few milliseconds, the piston 62 will move upwardly to allow a predetermined volume of chamber 50 to be filled by the pressurized fuel flowing past valve 72. If the solenoid 42 is energized for but the fraction of the total period needed to admit the maximum pressurized fuel into chamber 50, the chamber will be filled to a level commensurate with such fraction. In essence, the capability of an electronic controller to vary the duration of the period of energization of solenoid 42 enables the instant fuel injection system to achieve a variable metering capacity for each injector. Consequently, the same injector can be utilized effectively with a variety of engines calling for different amounts of fuel to be injected for optimum performance and under different operating conditions.

The operation of the fuel injection system can be summarized with reference to the timing chart of FIG. 11, which spans two complete revolutions of the crankshaft or 720° of revolution; the top dead center (TDC) position of the piston 18 is selected as the zero reference point. The solenoid 42 is normally de-energized, and the metering operation is initiated by a signal from a controller 25 received by the coil 108 of the solenoid 42 of the three-way valve 30. The termination of this signal, which is but a few milliseconds in duration, initiates the injection function. By varying the duration of the signal, the amount of fuel admitted to chamber 50 is varied, so that the quantity of fuel forced through injector nozzle 78 by the intensifier piston 62 during the next injection cycle, is varied. In addition to varying the duration of the signal, the timing in the cycle at which the fuel injection takes place can be controlled by varying the position of the end of the signal relative to engine events; the arrow accompanying the legend ADVANCE suggests the capability to alter the timing. The dotted lines in FIG. 11 denote the acceptable limits for the energization of the solenoid, and the time for the shuttle valve 38 and the intensifier piston 62 to complete the full extent of their travel. The dimensions show the permissible limits of shuttle travel (up to 0.060 inches) and intensifier piston travel (up to 0.177 inches). The dotted lines denote the ability of the instant injector to meter a quantity of fuel less than the quantity necessary to fill meterng chamber 50 and yet function effectively.

Sundry revisions and alterations to the fuel injection system described above will occur to the skilled artisan in the technology to which the invention pertains. For example, the solenoid could be normally maintained in its energized state, and could be turned off by a remote signal from the electric controller; however, while possible, the increase in the electrical power needed to maintain the solenoid energized might cause overheating, particularly at low engine speeds. Similarly, although a needle valve 144 is adjustable relative to its valve seat to control the rate of flow returning to reservoir 39, other mechanisms could be employed to define an adjustable, variable orifice in the outlet conduit 142, between the actuating chamber 49 and the shuttle chamber 37. Also, other forms of check valves could be employed in lieu of ball valve 72. In addition, the cooperation between movable valving sleeve 102 and fixed plunger 124 could be replaced by other valving arrangements which could selectively divert the flow of pressurized fuel. The shuttle valve 38 could assume diverse configurations, such as spool valves, interconnected ball valves, etc. Although intensifier piston 62 has been fabricated as a unitary member, the piston could be formed from separate cylindrical members joined together by springs. Also, minor piston 60 could be integrated into valve 38 as a larger, unitary member. Lastly, while the terms "downwardly" and "upwardly" are used to describe the movement of the shuttle valve and intensifier pistons, the direction of travel could be side to side, or the "up" and "down" directions could easily be reversed. Consequently, the appended claims should be construed in a manner commensurate with the significant advantages realized by the instant invention, and should not be narrowly construed or otherwise limited to their literal terms.

I claim:

1. A fuel injection system comprising, in combination,
(a) a housing,
(b) a multi-way valve located within said housing having an inlet passage (32) and a plurality of outlet passages (34, 36) formed therein,
(c) a reservoir (39) for storing fuel, said reservoir communicating with one of said outlet passages,
(d) pump means for withdrawing fuel from said reservoir and introducing same, at supply pressure, to said inlet passage of said multi-way valve,
(e) a shuttle chamber (37) located within said housng communicating with one of said outlet passages of said multi-way valve,
(f) electromagnetic means (42, 44, 108) disposed adjacent to said multi-way valve for selectively permitting communication between said inlet passage and said shuttle chamber or between said shuttle chamber and said one outlet passage,
(g) an electronic controller (25) for energizing said electromagnetic means to regulate the operation of said multi-way valve,
(h) an actuating chamber (49) and a metering chamber (50) defined within said housing,
(i) an intensifier piston (62) comprising an upper cylindrical member and a lower cylindrical member, said upper cylindrical member (64) being moveable within said actuating chamber as said lower cylindrical member (66) is moveable within said metering chamber,
(j) first conduit means (48) fed by said pump means for delivering fuel at supply pressure to said actuating chamber to drive said intensifier piston in a first direction during the actuation phase of the cycle of operation of said system,
(k) a nozzle (78) disposed downstream of said metering chamber and in communication therewith,
(1) spring means (94) and fuel at supply pressure normally biasing said nozzle closed,
(m) shuttle means (38) moveable within said shuttle chamber in response to a change of state of said electromagnetic means whereby said intensifier piston is driven in a first direction to amplify the pressure of the fuel in said metering chamber (50) to a level sufficient to overcome the bias of said spring means and the fuel at supply pressure to open said nozzle to discharge fuel therethrough,
(n) second conduit means (142) extending between said actuating chamber and said reservoir to allow fuel to return thereto, and
(o) variable orifice means (144, 144*a*, 146) situated in said second conduit means for adjusting the extent of displacement of said intensifier piston during the time that a signal from said controller energizes said electromagnetic means.

2. A fuel injection system as defined in claim 1 wherein said electromagnetic means is normally in its unactuated state and is only actuated intermittently to momentarily drive the intensifier piston in a second direction during the metering phase of the cycle of operation of said system.

3. A fuel injection system as defined in claim 1 wherein said variable orifice means is situated between said actuating chamber and said shuttle chamber.

4. A fuel injection system as defined in claim 3 wherein in said variable orifice means comprises a needle valve (144) and means (146) for adjusting the needle valve relative to a valve seat (144*a*) situated between said actuating chamber and said shuttle chamber.

5. A fuel injection system as defined in claim 1 wherein a check valve (72) is situated upstream of said metering chamber, said check valve retaining fuel in said metering chamber during movement of said intensifier piston in the first direction so that the pressure of the fuel is materially amplified.

6. A fuel injection system as defined in claim 1 wherein said shuttle means comprises a spool valve including a plurality of cylindrical segments joined by grooves of reduced diameter, the cylindrical segments conforming closely to the shuttle chamber as the spool valve moves therewithin, and the grooves allowing fuel at supply pressure to flow in the annular space between the valve and the shuttle chamber.

7. A fuel injection system as defined in claim 1 wherein third conduit means (54) are formed in said housing and a minor piston (60) is situated between said shuttle chamber and said third conduit means, said minor piston influencing the movement of said shuttle means.

8. A fuel injection system as defined in claim 7 wherein the cross-sectional area of said minor piston is only a fraction of the cross-sectional area of said shuttle means.

9. A fuel injection system as defined in claim 1 wherein the cross-sectional area of said lower cylinder of said intensifier piston is only a fraction of the cross-sectional area of said upper cylinder of said intensifier piston.

10. A fuel injection system as defined in claim 1 wherein a T-shaped passage (70) is formed through said lower cylinder of said intensifier piston, said T-shaped passage enabling a rapid bleed off of fuel trapped in said nozzle as the pressurized fuel is discharged therefrom.

11. A fuel injection system as defined in claim 10 wherein third conduit means (54) are formed in said housing and a cross-hole (55) communicates with said third conduit means, an enlarged annulus (56) defined in said cross-hole, and an undercut (150) formed at the upper end of said lower cylinder, the relatively large areas of said undercut and said annulus enabling the rapid expansion and discharge of the pressurized fuel trapped in said nozzle.

12. A fuel injection system as defined in claim 1 wherein third conduit means (54) are formed in said housing and a cavity (96) is formed in the interior of said nozzle, a cross-hole (55) and a fourth conduit means (98) communicate with said cavity to continuously feed fuel at supply pressure thereinto, a needle (90) is disposed within said nozzle, and a spring (94) is disposed within said cavity, wherein the combined forces of the fuel at supply pressure and the spring tending to retain the needle seated and the nozzle closed.

13. A fuel injection system as defined in claim 1 wherein a bleed passage extends between an enlarged annulus (37*a*) in the shuttle chamber, an enlarged annulus (49*a*) in the actuating chamber, and a common outlet port (140) to allow any fuel contained therein to be displaced to said reservoir during the injection phase of the cycle of operation.

14. A fuel injector comprising:

a housing, a multi-way valve located within said housing having an inlet passage (32) adapted to receive pressurized fuel and a plurality of outlet passages (34, 36) formed therein;

a shuttle chamber (37) located within said housing, said shuttle chamber communicating with one of said outlet passages of said multi-way valve;

electromagnetically actuated means (42, 44, 108) disposed adjacent to said multi-way valve for establishing communication between said inlet passage and said shuttle chamber in a first position and establishing communication between said shuttle chamber and one of said outlet passages in a second position;

an actuating chamber (49) and a metering chamber (50) disposed within said housing;

an intensifier piston (62) comprising an upper cylindrical member and a lower cylindrical member, said upper cylindrical member (64) being moveable within said actuating chamber and said lower cylindrical member (66) is moveable within said metering chamber;

first conduit means (48) for communicating said shuttle chamber to said actuating chamber, said first conduit means adapted to receive pressurized fuel from said shuttle chamber and deliver it to said actuating chamber to drive said intensifier piston;

a nozzle (78) disposed downstream of said metering chamber and in communication therewith;

hydraulic and mechanical means (94) for normally biasing said nozzle closed;

shuttle means (38) movably mounted within said shuttle chamber for establishing communication between the inlet passage and said first conduit means in a first position and blocking communication between the inlet passage and said first conduit means in a second position, said shuttle means adapted to move from said first position to said second position in response to a change of state of said electromagnetically actuated means;

second conduit means (142) extending from said actuating chamber and adapted to discharge fuel from said injector; and variable orifice means (144, 144*a*, 146) situated in said second conduit means for controlling the rate of discharge of fuel from said injector and whereby the displacement of said intensifier piston is controlled during the time that said electromagnetically actuated means is in said first position.

15. A fuel injector as recited in claim 14 wherein said variable orifice means is situated between said actuating chamber and said shuttle chamber.

16. A fuel injector as recited in claim 15 wherein said variable orifice means comprises a needle valve (144) and means (146) for adjusting the needle valve relative to a valve seat (144*a*) situated between said actuating chamber and said shuttle chamber.

* * * * *